US005374065A

United States Patent [19]

Motskin

[11] Patent Number: 5,374,065

[45] Date of Patent: Dec. 20, 1994

[54] METHOD OF PLAYING A WORD FORMING BOARD GAME

[76] Inventor: Samuel Motskin, 18 Lang Rd., Thornhill, Ontario, Canada, L3T 7E7

[21] Appl. No.: 95,404

[22] Filed: Jul. 23, 1993

[51] Int. Cl.[5] ..... A63F 3/00

[52] U.S. Cl. ..... 273/272; 273/299

[58] Field of Search ..... 273/272, 299; 434/159, 434/167, 171, 172

[56] References Cited

U.S. PATENT DOCUMENTS 4,448,423 5/1984 Augusta ..... 273/272

4,896,889 1/1990 Kuhn et al. ..... 273/272

OTHER PUBLICATIONS

"Scrabble", *Playthings*, Jan. 1956, p. 4.

*Primary Examiner*—Mark S. Graham

*Assistant Examiner*—William M. Pierce

*Attorney, Agent, or Firm*—Hugh E. Smith

[57] ABSTRACT

A language building game for two to four players utilizing a grid marked game playing board, a pool of playing tiles each bearing a letter of the alphabet on its face, and a scoring sheet for each player. The game method includes placing a first plurality of tiles on the board by a first player, placing only a single tile on the board adjacent to the first plurality of tiles by the second player, wherein the first and second players continue to build about the first plurality of tiles and the single tile by placing additional pluralities of tiles on the board.

1 Claim, 3 Drawing Sheets

METHOD OF PLAYING A WORD FORMING BOARD GAME

BACKGROUND OF THE INVENTION

1. Field of the Invention

The present invention relates to board word games and more particularly pertains to such a game which challenge the players in their word skills.

2. Description of the Prior Art

The use of word board games is known in the prior art. More specifically, such games heretofore devised and utilized for the purpose of entertainment and developing word skills are known to consist basically of familiar, expected and obvious structural and mental configurations, notwithstanding the myriad of designs encompassed by the crowded prior art which have been developed for the fulfillment of countless objectives and requirements. Typical games are shown in U.S. Pat. Nos. 5,026,071; 4,955,614; 4,819,945; 4,365,813; and 4,185,834.

In this respect, the language building games according to the present invention substantially departs from the conventional concepts and designs of the prior art, and in so doing provides a game primarily developed for the purpose of challenging players in their word skills.

Therefore, it can be appreciated that there exists a continuing need for new and improved word board games which can be utilized in developing languages skills. In this regard, the present invention substantially fulfills this need.

SUMMARY OF THE INVENTION

In view of the foregoing disadvantages inherent in the known types of board word games now present in the prior art, the present invention provides an improved word game construction wherein the same can be utilized for developing language skills in an entertaining manner. As such, the general purpose of the present invention, which will be described subsequently in greater detail, is to provide a new and improved word board game which has all the advantages of the prior art games and none of the disadvantages.

To attain this, the present invention essentially comprises a language building game for two to four players utilizing a grid marked game playing board, a pool of playing tiles each bearing a letter of the alphabet on its face, and a scoring sheet for each player wherein:

Play comprises: Player one declares an initial word, enters such word on his or her score sheet and places letter tiles across the center of the game board to spell out the declared word.

The next player attempts to declare a word which will embed the initial word therein. If successful such player declares such word, enters it in the score sheet and places the letter tiles therefor on the game board. If unsuccessful, the player declares a word utilizing one of the letters from the initial word, enters it on the score sheet and places a letter tile from such declared word on the game board adjacent the letter of the initial word which it abuts in the new declared word.

Subsequent players attempt to embed the existing word or declare and record a new word utilizing the letters of the chain started by preceding players. Failing this the subsequent player may declare and add a new word utilizing one of the letters on the board and places letter tiles spelling out such word on the game board. Play then continues as above.

Scoring comprises: scoring each word as it is declared and entered on the score sheet according to enumerated rules discussed below.

Limitations comprise: a list of prohibited types of words as defined hereafter.

The game may also be built into a computer program substituting the screen of a computer as the game and scoring board with the rules built into a .disc or cartridge.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved word board game which has all the advantages of the prior art games and none of the disadvantages.

It is another object of the present invention to provide a new and improved language building game which may be easily and efficiently manufactured and marketed.

It is a further object of the present invention to provide a new and improved word board game which is of a durable and reliable construction.

An even further object of the present invention is to provide a new and improved word board game which is susceptible of a low cost of manufacture with regard to both materials and labor, and which accordingly is then susceptible of low prices of sale to the consuming public, thereby making such games economically available to the buying public.

Still another object of the present invention is to provide a new and improved word board game which challenges the intellect of the players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
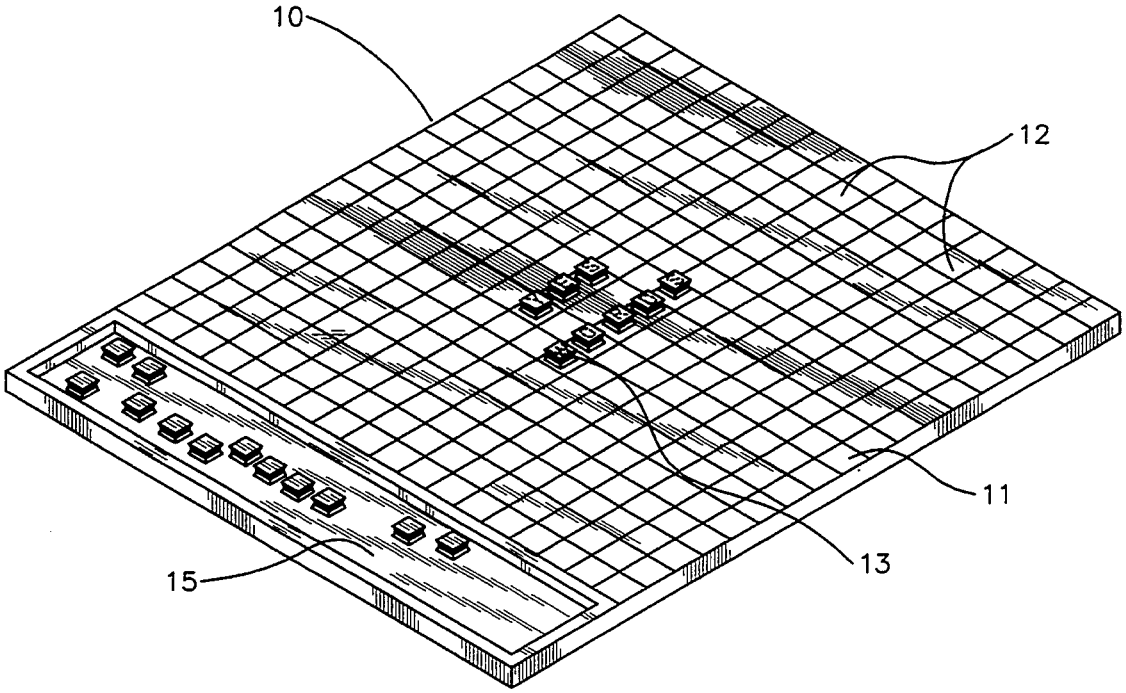
FIG. 1 is a perspective view of the manner in which letters are displayed on the game board.

With reference now to the drawings, and in particular to FIG. 1 thereof, a new and improved board word game embodying the principles and concepts of the present invention and generally designated by the reference numeral 10 will be described.

Figure 2:
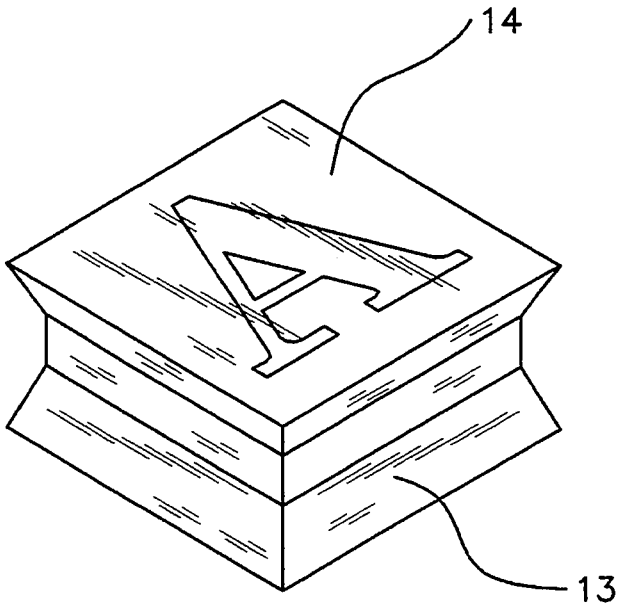
FIG. 2 is a perspective view of a letter tile of the invention.

The physical requirements of the game constitute a game board 11 having a grid of squares 12 on the surface thereof. A plurality of tiles 13 adapted to sit on board 11 within squares 12 are also needed. As shown in FIG. 2, the tiles 13 bear on one face thereof a letter indicia 14. A plurality of such tiles 13 are required with all letters of the alphabet represented on at least one tile per letter, and with more of the commonly used letters such as "E" or "S" than of infrequently used letters such as "X" and "Z". The exact number of tiles is not critical to the game but should be sufficient to supply up to four players with a suggested minimum of eight each, i.e. 32 or more tiles. As explained below, the tiles are not distributed among the players but are available from a common pool as shown at 15 in FIG. 1.

Figure 3:
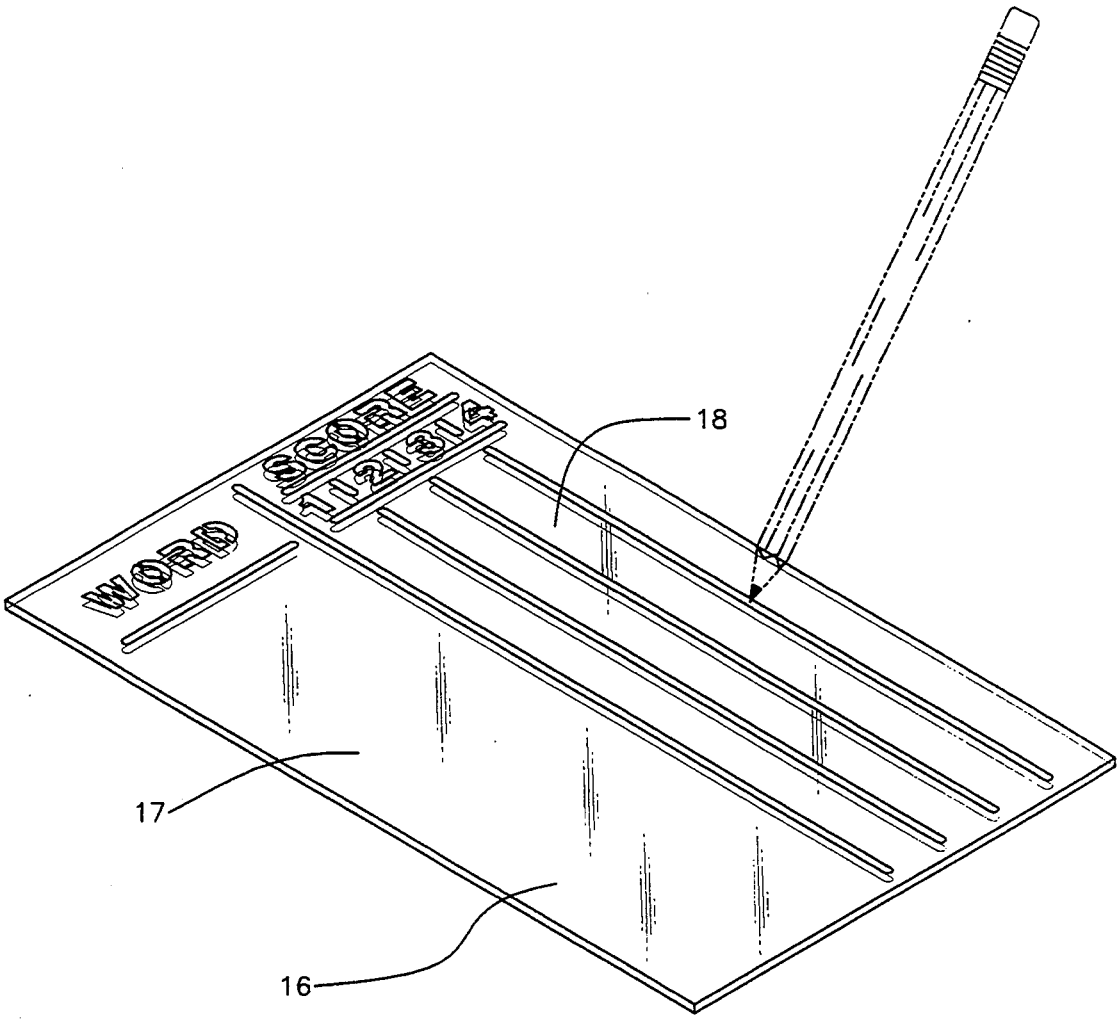
FIG. 3 is a perspective view of a score sheet for the present game.

Also required is a score sheet 16 for each player as shown in FIG. 3. A wide section 17 of such sheet 16 is provided under the heading "WORD" and a series of four narrower sections 18 are provided under the heading "SCORE".

The balance of the physical requirements consist of playing letters and scoring with the main challenge coming in mentally selecting a word within the limits defined below which will enhance the player's score and undermine an opponents attempt to score.

The game commences with the first player selecting a word and placing the tiles spelling such word on the board so as to cover the center source or,such board. The declared word is written on the player's score sheet and scored as outlined below.

The second player attempts to declare a word which will embed the first word within such declared word, i.e., if the first word is "LEASE" the second player may declare, "PLEASE" thus embedding the first word within the second. In such instance the additional letters used are added to the word on the board. If unable to "embed" the word, the player may declare a new word providing it uses one of the letters of the existing word. The player records and scores such declared word and places one letter only of such declared word adjacent whichever letter of the existing word in the proper relationship whereto as in the declared word. Such letter may be placed in any direction, up, down, sideways, or diagonally on the board so long as it abuts the letter already present on such board. The next player must build on the chain of the second players addition, declaring a word which will have the two letters of the second player's placement therein in adjoining relationship. Again such word is recorded and scored and play continues in this fashion until a player can no longer add to this line of letters. If a player does so add and makes a word thereby his score increases as indicated below. Once stymied, the player may add a new word using one of the letters of the existing word or words on the board and putting down the tiles spelling such word. Play then continues as above until no player can execute any maneuver as above. Then points are totaled to determine the winner.

A plurality of restrictions apply to word selection and may be termed "ILLEGAL OPTIONS" the list thereof is as follows:

ILLEGAL OPTIONS

Gerunds
Prepositions
Plurals
Any verb other than an infinitive
Comparative adjectives
Suffixes which keep the basic connotation unchanged
Combining words normally written as two words
Prefixes

SCORING

Declaring a new word: 1 point
Completing a word: 1 point
Declaring a new word which embeds an existing word:
- (a) If a composite of the existing word and the added newly declared word: 0.5 points
- (b) If the new word has a completely different meaning: 1.5 points Using more than one letter on the board: 1 point/letter
Points are deducted for:
- Error in word: 1 point
- Using a dictionary to declare a new word: 0.5 points
- Using dictionary when completing a word: 1 point
- Using a dictionary when starting a new word: 2 points As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

For example, while illustrated as a game board type word game, the game of the present invention, following the same rules laid down above, may be converted to use on a computer screen, utilizing a window thereon in which the running score is shown. With the computer arrangement there is an automatic spell check as a word is keyed in; word restrictions are enforced automatically; and score is automatically kept and displayed on the screen. Also special graphic and sound effects may be built into the program, i.e. pop-up images and messages may be utilized as well as various sounds to denote misspellings, etc.

What is claimed as being new and desired to be protected by Letters Patent of the United States is as follows:

1. A method of playing a language building game for a plurality of players utilizing a grid marked playing board having a center, a plurality of playing tiles each bearing a letter of the alphabet on a face thereof, and a scoring sheet for each of said players, said method comprising the steps of:

(a) declaring a first word by a first player;

(b) recording said first word on said scoring sheet of said first player;

(c) placing a plurality of Said tiles on said playing board such that said letters of said plurality of tiles spell said first word, one of said tiles being positioned upon said center of said playing board;

(d) scoring by awarding to said first player: one point for completion of step (a), one point for completion of step (c);

(e) scoring by deducting from said first player: one point for a misspelling of said first word, two points for utilizing a dictionary to declare said first word, and one point for using said dictionary to spell said first word;

(f) declaring a second word by a second player which cooperates with said first word in a manner selected from the group consisting of: adding a letter of said second word to a letter of said first word to form said second word, and utilizing a letter of said first word to form a portion of said second word adjacent a letter of said second word;

(g) recording said second word on said scoring sheet of said second player;

(h) placing only one of said tiles corresponding to said letter of said second word adjacent said tile corresponding to said letter of said first word;

(i) scoring by awarding to said second player: one point for completion of step (f), one point for completion of step (h);

(j) scoring by deducting from said second player: one point for a misspelling of said second word upon said sheet, one-half point for utilizing said dictionary to declare said second word, and one point for using said dictionary to spell said second word;

(k) declaring another first word by said first player which cooperates with said letter of 'said second word in a manner selected from the group consisting of: adding a letter of said first word to said letter of said second word to form said first word, and utilizing said letter of said second word to form a letter of said first word;

(l) recording said first word on said scoring sheet of said first player;

(m) placing a plurality of said tiles corresponding to said first word adjacent said letter of said second word to spell said first word;

(n) scoring by awarding to said first player: one point for completion of step (k), one point for completion of step (m);

(o) scoring by deducting from said first player: one point for a misspelling of said first word on said sheet, one-half point for utilizing said dictionary to declare said first word, and one point for using said dictionary to spell said first word;

(p) declaring another second word by said second player which cooperates with any letter of said first word in a manner selected from the group consisting of: adding a letter of said second word to said first word to form said second word, and utilizing any letter of said first word to form a letter of said second word;

(g) recording said second word on said scoring sheet of said second player;

(r) placing a plurality of said tiles corresponding to said second word adjacent said first word to spell said second word;

(s) scoring by awarding to said second player: one point for completion of step (p), one point for completion of step (r);

(t) scoring by deducting from said second player: one point for a misspelling of said second word on said sheet, one-half point for utilizing said dictionary to declare said second word, and one point for using said dictionary to spell said second word;

(u) declaring another first word by said first player which cooperates with any letter of said second word in a manner selected from the group consisting of: adding a letter of said first word to said second word to form said first word, and utilizing any letter of said second word to form a letter of said first word;

(v) recording said first word on said scoring sheet of said first player;

(w) placing a plurality of'said tiles corresponding to said first word adjacent said second word to spell said first word;

(x) scoring by awarding to said first player: one point for completion of step (u), one point for completion of step (w);

(y) scoring by deducting from said first player: one point for a misspelling of said first word on said sheet, one-half point for utilizing said dictionary to declare said first word, and one point for using said dictionary to spell said first word;

(z) continuing play by repeating steps (p) through (y) until either of said players cannot declare a word in accordance with seeps (p) and (u); and, (zz) declaring a winner as the player with the highest number of points.

* * * * *